US005877729A

United States Patent [19]

Holloway et al.

[11] Patent Number: 5,877,729

[45] Date of Patent: Mar. 2, 1999

[54] WIDE-BEAM HIGH GAIN BASE STATION COMMUNICATIONS ANTENNA

[75] Inventors: Jesse Carol Holloway; Robert Blaine Liechty, both of Greenville, Tex.

[73] Assignee: Raytheon Company, Lexington, Mass.

[21] Appl. No.: 684,980

[22] Filed: Aug. 22, 1996

Related U.S. Application Data

[60] Provisional application No. 60/002,763, Aug. 24, 1995.

[51] Int. Cl.[6] ..... H01Q 13/10

[52] U.S. Cl. ..... 343/767; 343/768

[58] Field of Search ..... 343/767, 857, 343/768, 770, 771; H01Q 13/10

[56] References Cited

U.S. PATENT DOCUMENTS

| | | | |
|---|---|---|---|
| 2,238,770 | 4/1941 | Blumlein | 343/767 |
| 2,799,017 | 7/1957 | Alford | 343/767 |
| 2,818,565 | 12/1957 | Atioka et al. | 343/767 |
| 4,367,475 | 1/1983 | Schiavone | 343/767 |

*Primary Examiner*—Hoanganh Le

*Attorney, Agent, or Firm*—Baker & Botts, L.L.P.

[57] ABSTRACT

A slot antenna having an elongated tube with a slot extending along the longitudinal axis of the tube provides an antenna structure for a wide-band communications antenna. The configuration of the tube and slot provide an antenna with an input impedance of about 50 ohms. A plurality of feed points are spaced along the slot for radiating and receiving wideband RF signals. When oriented vertically with respect to the earth, the antenna radiates and receives horizontally polarized signals with a high rejection of vertically polarized signals. When oriented horizontally with respect to the earth, the antenna radiates and receives vertically polarized signals with a high rejection of horizontally polarized signals. The antenna tube is coupled to a rectangular ground plane extending substantially the length of the antenna tube. The antenna provides high gain and, with the attached ground plane, provides a wide beamwidth greater than 180 degrees in the azimuth direction (when oriented vertically) or the elevation direction (when oriented horizontally). The plurality of feed points allow for an additional capability of beamsteering in the elevation direction (when oriented vertically) or the azimuth direction (when oriented horizontally).

3 Claims, 4 Drawing Sheets

FIG. 1
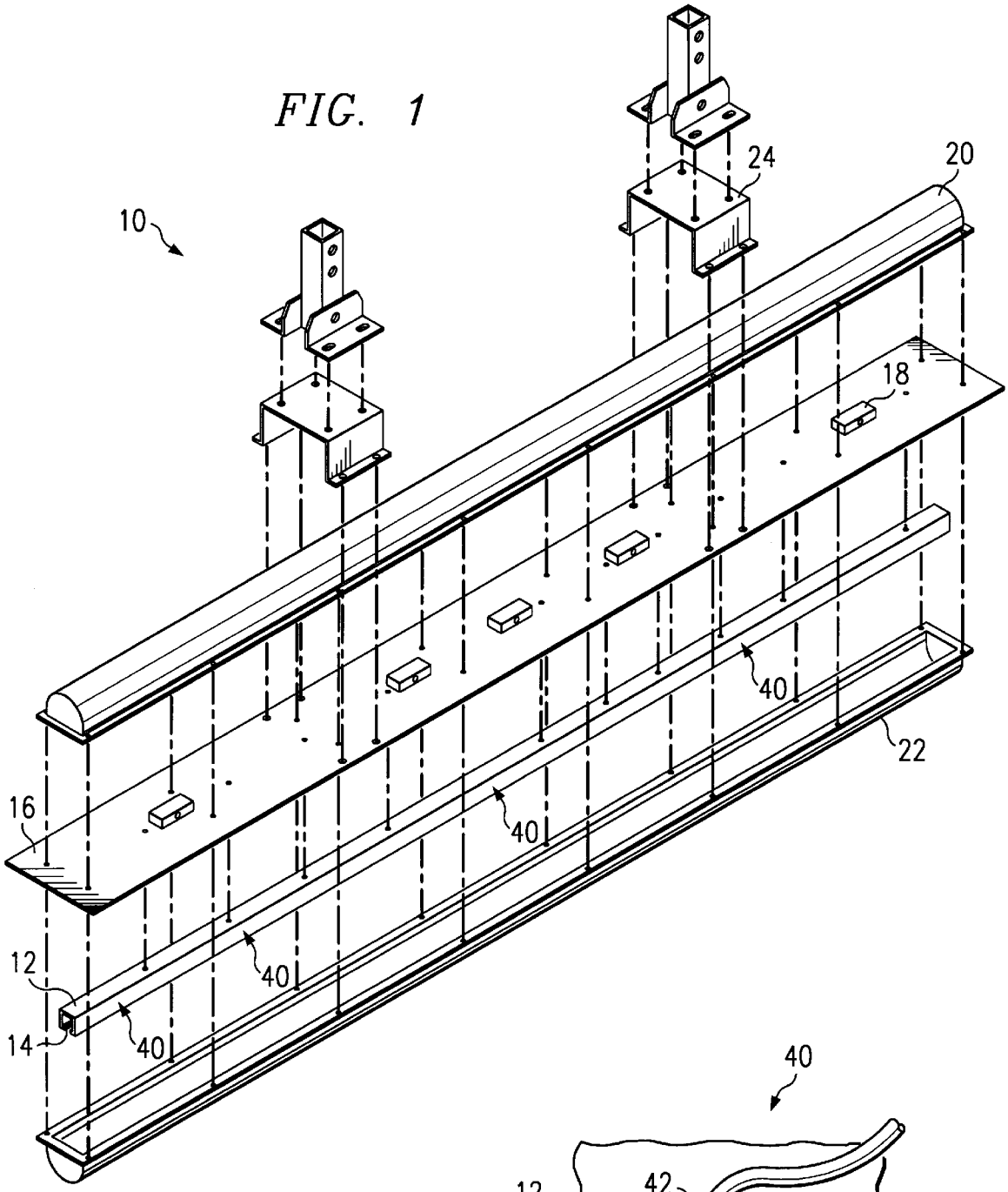
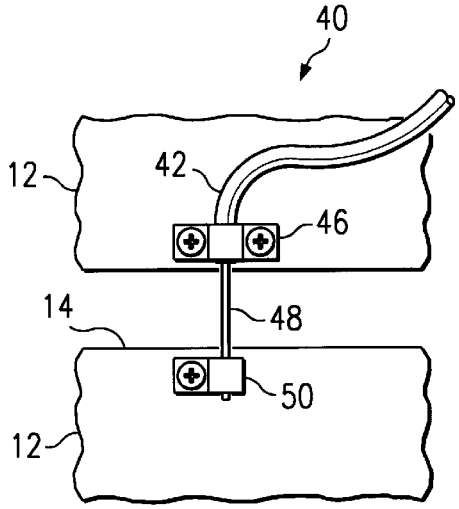
FIG. 5

FIG. 2
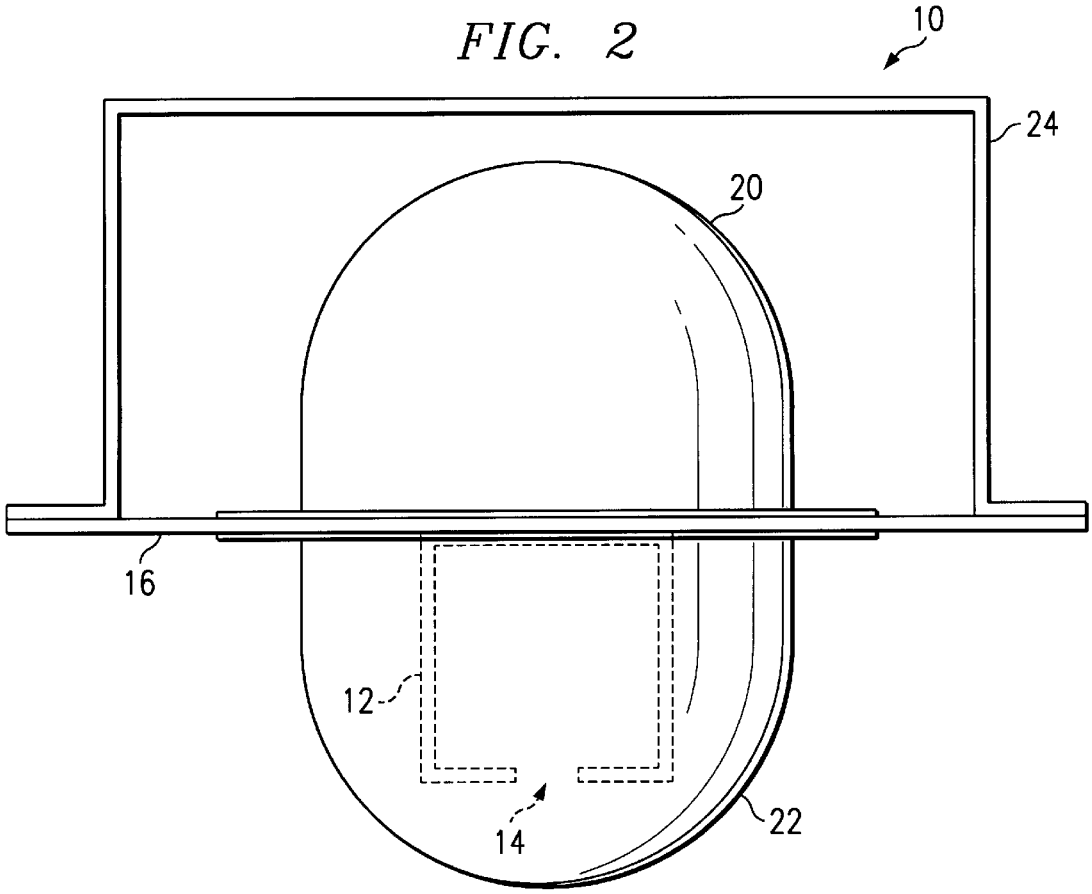
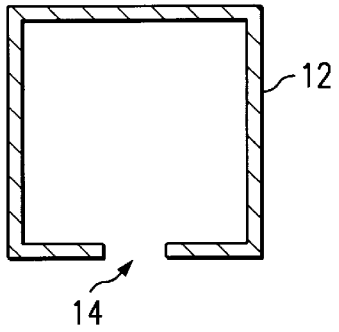
FIG. 3A
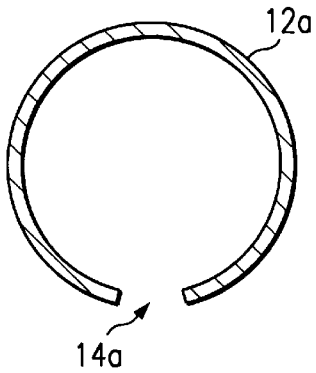
FIG. 3B
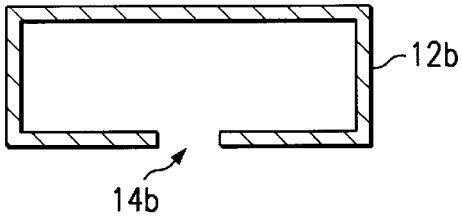
FIG. 3C

WIDE-BEAM HIGH GAIN BASE STATION COMMUNICATIONS ANTENNA

CROSS REFERENCE TO RELATED APPLICATION

This application claims the benefit of priority under 35 U.S.C. § 119(e)(1) of Provisional Patent Application No. 60/002,763, filed Aug. 24, 1995, entitled "Wide-Beam High Gain Base Station communications Antenna," and converted to a regular utility patent on Aug. 22, 1996.

BACKGROUND OF THE INVENTION

TECHNICAL FIELD

The present invention relates to a communications antenna and, in particular, to a wide-beam high gain base station communications antenna for receiving and transmitting electromagnetic signals in cellular communications.

BACKGROUND OF THE INVENTION

In general, communication systems antennas emit and/or receive communication signals propagating through air and space. Numerous different types of communications antennas are in use today. Antennas transmit (and receive) electromagnetic waves made of a combination of electric and magnetic fields propagating in a certain direction. The electric and magnetic fields are perpendicular to each other and are perpendicular to the direction of propagation of the electromagnetic wave (EM wave).

The orientation of the electric and magnetic fields with respect to the surface of the earth determines whether the electromagnetic wave (the communication signal) is vertically or horizontally polarized. If the electric field is parallel to the earth, the EM wave is horizontally polarized. If the electric field is perpendicular to the earth, the EM wave is vertically polarized. The structure and orientation of an antenna dictates whether the antenna emits or receives vertically or horizontally polarized EM waves (some structures emit and/or receive circularly polarized EM waves, however circular polarization will not be discussed herein). Generally, both the transmit and receive antennas in a communications system must be of the same polarization for proper transmission and reception.

Antennas radiate and receive energy in many different directions, however, most antennas radiate or receive energy in a very specific geometric radiation pattern that is non-uniform over a 360 degree circle parallel to the earth's surface. Antennas exhibiting this characteristic are called directional antennas. Some antennas are constructed (or oriented) to radiate or receive energy in all directions parallel to the surface of the earth. These antennas are called omni-directional antennas.

For example, a half-wave dipole antenna has a radiation pattern in the shape of a doughnut. Most of the energy radiated from a half-wave dipole is radiated substantially from right angles to the length of the dipole. As such, almost no energy is radiated along the lines extending along the length of the dipole. A half-wave dipole mounted horizontally to the earth (horizontal polarization) is a directional antenna (ie., minimal radiation in the directions along the length of the dipole). A half-wave dipole mounted vertically to the earth (vertical polarization), therefore, is an omni-directional antenna (i.e., equal amount of radiation in all directions parallel to the earth). In the transmission mode, a dipole antenna should be pointed broadside to the desired direction of transmission or, in the reception mode, pointed broadside to the point of transmission of the signal from a transmitter.

Standard ground mobile cellular communications systems (ground-to-ground) use vertically polarized signals in the 800–900 MHz range. In order to reuse the same RF spectrum as ground-to-ground cellular systems, aircraft cellular communications system (air-to-ground) use horizontally polarized signals to prevent interference with the vertically polarized ground mobile cellular communication systems. While RF power management control techniques may help reduce some of this interference, a substantial amount of interference is still present. As such, the design of the aircraft antenna (coupled with the attributes of the operating environment, i.e., air-to-ground communication from a moving aircraft) plays a critical role in the performance of the aircraft cellular communications system. It must provide a high rejection of the vertically polarized ground communications signals.

Slotted antennas are sometimes used as base station antennas in communications systems. Slotted-cylinder type antennas primarily have a single fed slot or aperture with low gain and computed directivities on the order of 3–6 dBLi. As such, axial slotted cylinders have been typically used in narrowband applications as single elements. The input impedance for slot antennas formed in a metallic sheet are typically in the range of 500 ohms with cavity-backed slotted antenna exhibiting even higher input impedances approaching 1000 ohms. High input impedances for slotted antennas require additional and costly matching networks in order for a typical transmitter to be matched, as typical transmitters normally are matched to 50 ohm impedances.

Accordingly, there exists a need for a wide-bandwidth slotted antenna for use as an antenna in a communications system that transmits and receives polarized (either horizontal or vertical) signals and provides high rejection of opposite polarized communications signals. Further, there is needed a slot antenna exhibiting an input impedance in the range of 50 ohms thereby reducing or eliminating additional and costly matching networks. Also, there is needed a slot antenna having a single slot with multiple feed points along the slot allowing equal phase or progressive phase shifting for beamsteering capabilities. Additionally, there is needed a slotted antenna having high gain and yielding azimuth (or elevation, depending on orientation) radiation beamwidths of greater than 180 degrees with an attached ground plane. In addition, there exists a need for a high gain, wideband slot antenna for use as a base station antenna in an aircraft cellular communications system that transmits and receives horizontally polarized signals and provides high rejection of vertically polarized ground mobile cellular communications signals.

SUMMARY OF THE INVENTION

According to the present invention, there is provided an antenna radiating element including an elongated tube having a single aperture or slot extending along the longitudinal length of the tube. A plurality of feed points along the slot radiate and receive horizontally polarized signals and substantially reject vertically polarized signals when the longitudinal axis of the antenna element is oriented substantially perpendicular to the earth's surface. The antenna element radiates and receives vertically polarized signals and substantially rejects horizontally polarized signals when the longitudinal axis of the antenna is oriented substantially parallel to the earth's surface.

In accordance with the present invention, there is provided a single slotted antenna having a plurality of feed points along the slot. Incorporation of delay line steering or n-bit phase shifters in each of the feed paths for each of the plurality of feed points provides for beamsteering in the elevation direction (if the longitudinal axis of the antenna is oriented perpendicular to the earth's surface) or in the azimuth direction (if the antenna is oriented parallel). An attached ground plate coupled to the side of the tube opposite the slot provides a beamwidth of greater than 180 degrees in the azimuth direction (or elevation direction, depending on the orientation of the antenna).

DESCRIPTION OF THE DRAWINGS

For a more complete understanding of the present invention and the advantages thereof, reference is made to the following detailed description taken in conjunction with the accompanying drawings wherein:

FIG. 1 is an elevational view illustrating an antenna system in accordance with the present invention;

FIG. 2 illustrates a top view of the antenna system shown in FIG. 1;

FIG. 3A is a cross-sectional view of a preferred embodiment of an antenna radiating element in accordance with the present invention; and FIG. 3B is a cross-sectional view of an alternative embodiment of the antenna radiating element in accordance with the present invention; and FIG. 3C is a cross-sectional view of another alternative embodiment of the antenna radiating element in accordance with the present invention;

FIG. 5 illustrates a preferred configuration of the feed points in the slot antenna in accordance with the present invention;

DETAILED DESCRIPTION

Figure 4A:
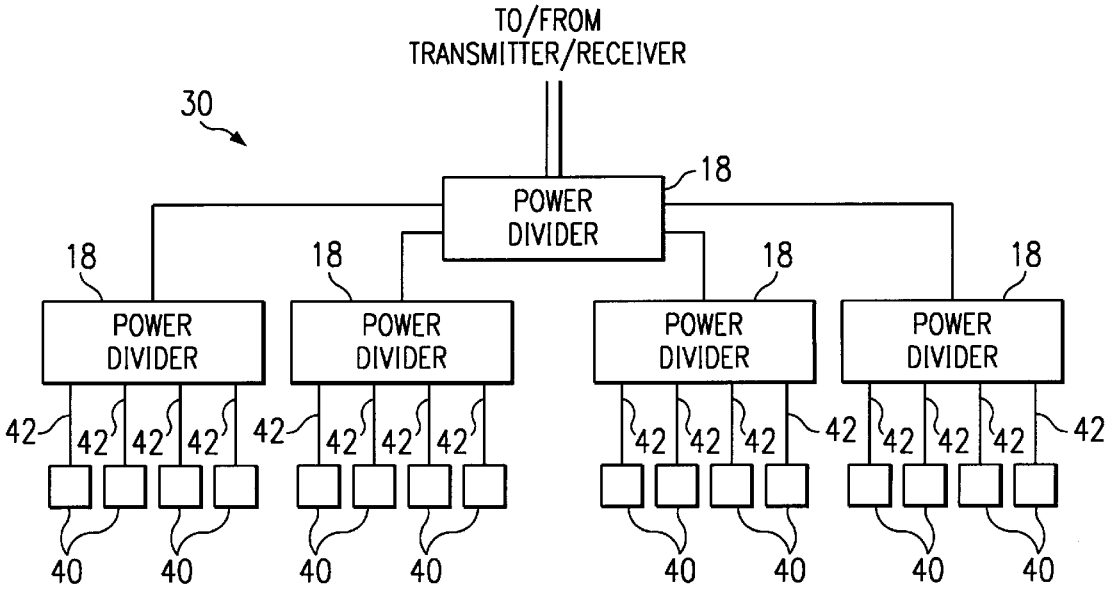
FIG. 4A illustrates one embodiment of a distribution feed network for the slot antenna in accordance with the present invention.

With reference to the drawings, like reference characters designate like or similar parts throughout the drawings.

Referring now to FIGS. 1 and 2, there is shown an elevated separated view and a top view of an antenna system 10 in accordance with the present invention. The antenna system 10 includes an elongated antenna element 12 having an aperture or slot 14 extending substantially along the longitudinal length of the antenna element 12. A ground reference plate 16 is coupled to a side of the antenna element 12 opposite the slot 14. The ground reference plate includes one or more power dividers/combiners 18 for providing a feed distribution network to a plurality of feed points 40 (not shown in FIG. 2) spaced along the slot 14. In the preferred embodiment, there are sixteen feed points 40 spaced evenly along the slot 14. As will be appreciated, the number of feed points can vary depending on the desired amount of gain, frequencies used, and other parameters.

The antenna system 10 also includes an elongated radome having a back section 20 and a front section 22 for protecting the antenna element 12 and feed distribution network from the environment. The radome sections 20, 22 are connected to the plate 16. A pair of mounting brackets 24 are provided for mounting the plate 16 (and antenna element 12 and radome sections 20, 22) to a tower, building, aircraft, etc. or the like.

In the preferred embodiment, the ground reference plate 16 is constructed of metal having a thickness of approximately ⅛ inch. As will be appreciated, the plate 16 generally has various holes or apertures for providing feed paths for the feed distribution network (not shown). One or more power dividers 18 are mounted or attached to the plate 16 by screws, bolts or the like. The radome front section 20 and radome back section 22 are constructed of epoxy/fiberglass and are wet sealed and attached to the plate 16 using any conventional means. In the preferred embodiment, the radome has two sections 20, 22. As will be appreciated, with minor modifications, the radome may be constructed as one integral piece surrounding the antenna element 12 and plate 16.

As will be appreciated, the antenna element 12 is an elongated tube having a square, circular, rectangular or elliptical shape. The aperture or slot 14 extends lengthwise along the longitudinal axis of the antenna element 12 and substantially along the entire length of the antenna element 12. As such, the antenna element 12 is an axially slotted cylinder. In the preferred embodiment, the length of the antenna element 12 is about 143 inches and the frequency of operation is in the range of 824–894 MHz with a center frequency of 859 MHz.

Now referring to FIGS. 3A, 3B and 3C, there are illustrated several embodiments of the cross-sectional shape of the antenna element 12. The preferred embodiment of the antenna element 12 is shown in FIG. 3A having the shape of a square. The antenna element 12 has sides that are approximately 2.2 inches in length. The width of the slot 14 is approximately ⅜ inch. An alternative embodiment of an antenna element 12*a* is shown in FIG. 3B. The antenna element 12 is circular in shape with a diameter of approximately 2½ inches and having a slot 14*a* with a width of approximately ⅜ inch. Another alternative embodiment of an antenna element 12*b* is shown in FIG. 3C wherein the antenna element 12*b* is rectangular in shape and having a slot 14*b* with a width of approximately ⅜ inch.

In general, the input impedance of the antenna is a function of the perimeter length (circumference) of the antenna element 12 and the width of the slot 12. The configurations of the antenna elements 12, 12*a* provide an input impedance of approximately fifty ohms. As such, the present invention provides a single slot antenna with a plurality of feed points having an input impedance at each feed point of approximately 50 ohms. Off-the-shelf components can be used in the distribution network and feed networks for feeding the feed points 40. This results in the reduction or elimination of additional and costly matching networks required when a slot antenna is used having input impedances substantially greater than fifty ohms.

Now referring to FIG. 4A, there is illustrated a preferred feed distribution network 30 including five 1-to-4 power dividers 18. The feed distribution network 30 distributes the signal along the slot 14 at sixteen separate feed points 40.

The feed points 40 are spaced along the slot at a distance equal to about 0.7 wavelength of the center frequency. As will be appreciated, while an increase in feed point spacing increases gain, it has been found that the spacing of the feed points should generally be less than about 0.75 wavelength. Further, if beamsteering is performed, the feed point spacing should be generally less than 0.5 wavelength in order to prevent grating lobes in visible space.

A horizontal radiation pattern with highly suppressed vertical components (>20 dB) is obtained with the longitudinal axis of the slotted antenna element 12 positioned vertically (i.e., perpendicular to the earth's surface) and fed horizontally across the slot 14. Alternatively, a vertical radiation pattern with highly suppressed vertical components (>20 dB) is obtained with the longitudinal axis of the slotted antenna element 12 positioned horizontally (i.e., parallel to the earth's surface) and fed vertically across the slot 14.

Figure 4B:
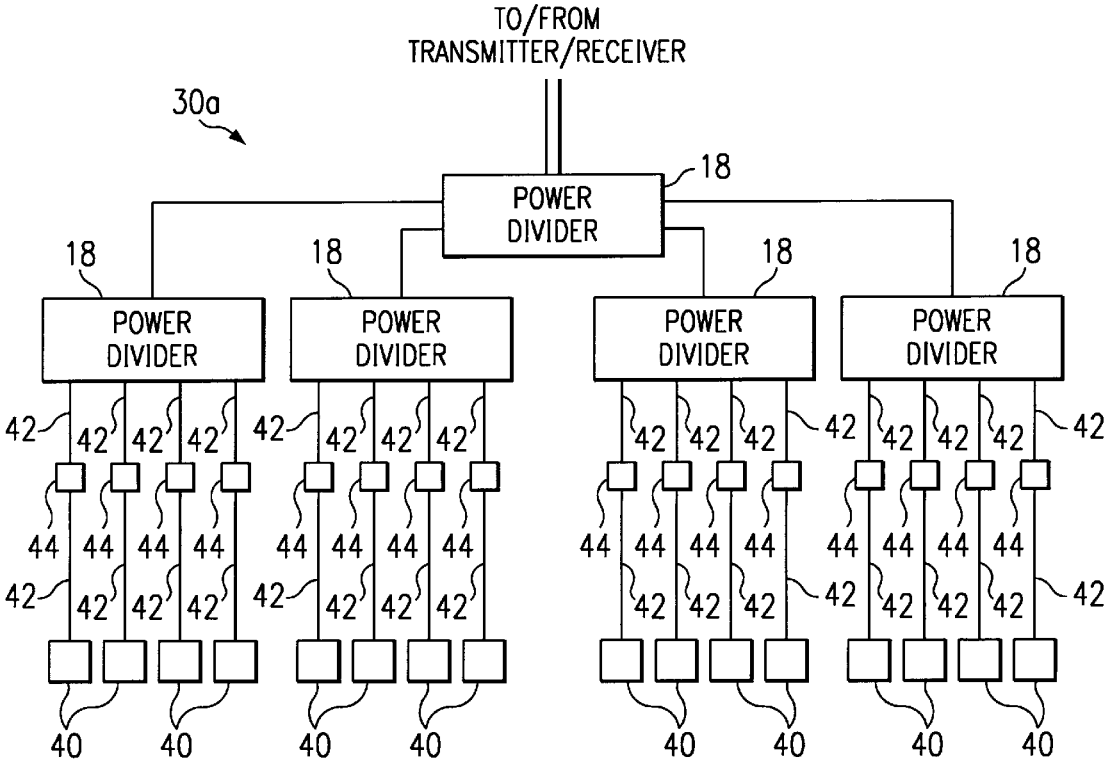
FIG. 4B illustrates a second embodiment of a distribution feed network for the slot antenna in accordance with the present invention.

Since the input impedance at the feed points is approximately fifty ohms, RF coaxial cables 42 are used for transmission of the signals to the feed points 40. As will be appreciated, the antenna system 10 can be operated with a static broadside beam or with beamsteering. In broadside beam radiation, the plurality of feed points 40 are fed with equal phase. This is normally accomplished by providing equal length feed paths to the feed points 40. In order to provide beamsteering capabilities, the addition of delay line steering (i.e., different length feed paths) or n-bit phase shifters, or the like, is inserted in each of the feed paths to each of the feed points 40. In either case, ie., equal phase feeding or progressive phase shift feeding to the feed points, the phase of the signal is made continuous along the structure and thereby reduces sidelobe effects. Now referring to FIG. 4B, there is illustrated an alternative feed distribution network 30*a* having a plurality of n-bit phase shifters 44 inserted in each feed path to the feed points 40. The phase shifters are controlled by a processor (not shown) to allow adaptive control of the beamsteering.

The antenna element 12 of the present invention effectively allows beamsteering over a wider range of frequencies than conventional slotted array antennas. In most applications, it is believed the antenna element 12 with beamsteering capabilities may accomplish beamsteering approaching up to about forty-five degrees.

Now referring to FIG. 5, there is illustrated a feed point 40 in accordance with the present invention. The RF coaxial cable 42 feeds a RF signal from the feed distribution network 30 (shown in FIG. 4A). The RF coaxial cable 42 is rigidly attached to a side of the antenna element 12 by a clamp 46. The ground shielding of the RF coaxial cable 42 is terminated at the clamp 46. The center conductor 48 of the cable 42 is positioned to extend across the width of the slot 14 of the antenna element 12 and is terminated by a clamp 50 mounted to the antenna element 12.

Figure 6A:
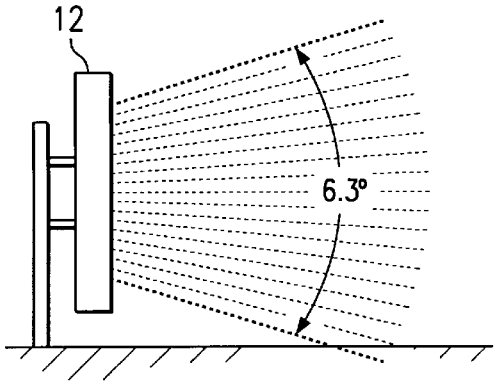
FIG. 6A is a side view illustrating an elevation beamwidth for the present invention.
Figure 6B:
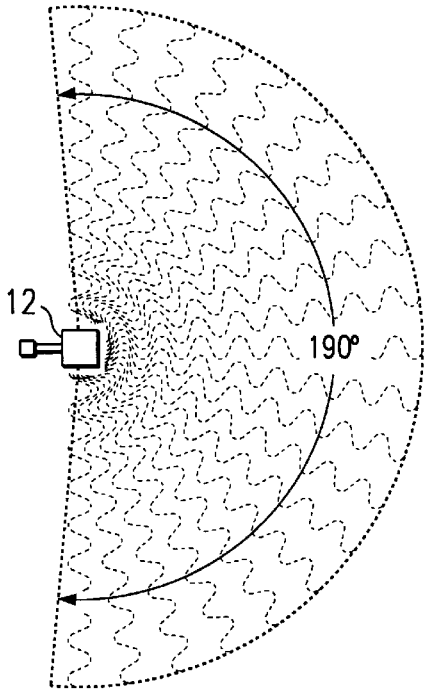
FIG. 6B is a top view illustrating an azimuth beamwidth for the present invention.

Now referring to FIG. 6A, 6B, 6C and 6D, there is illustrated beamwidth patterns for the present invention. FIG. 6A and 6B illustrate the beamwidths where the longitudinal axis of the antenna element 12 of the present invention is orientated substantially perpendicular to the earth's surface to radiate and receive horizontally polarized signals. In FIG. 6A, the elevation beamwidth produced in accordance with the present invention is shown having an angle of approximately 6.3 degrees. As will be understood, the elevation angle can be beamsteered if the present invention comprises beamsteering capabilities. In FIG. 6B, the azimuth beamwidth produced in accordance with the present invention is shown having an angle of greater than 180 degrees. This particular beamwidth is achieved with the antenna element 12 having the ground reference plate 16. The azimuth beamwidth is nearly omni-directional without the use of the plate 16.

Figure 6C:
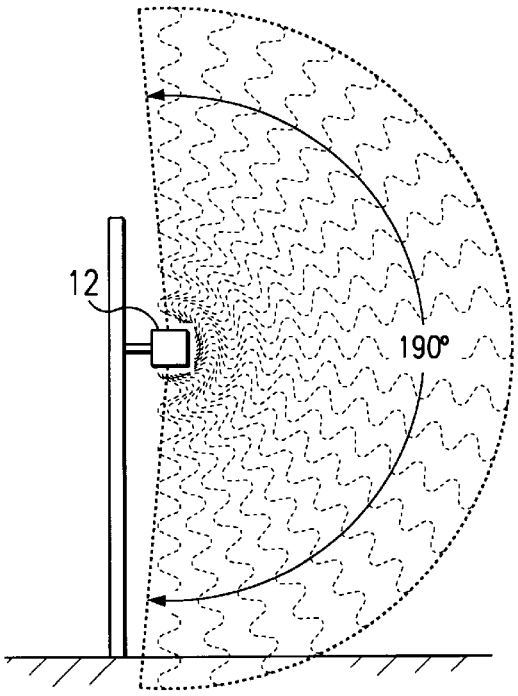
FIG. 6C is a side view illustrating an elevation beamwidth for the present invention.
Figure 6D:
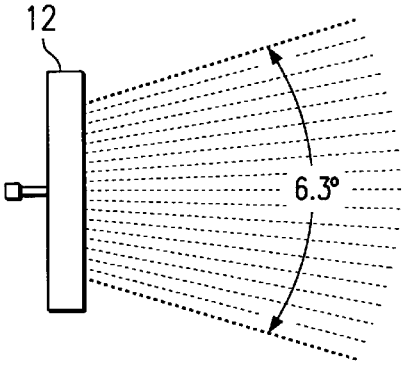
FIG. 6D is a top view illustrating an azimuth beamwidth for the present invention.

FIG. 6C and 6D illustrate the beamwidths where the longitudinal axis of the antenna element 12 of the present invention is orientated substantially parallel to the earth's surface to radiate and receive vertically polarized signals. In FIG. 6C, the elevation beamwidth produced in accordance with the present invention is shown having an angle greater than 180 degrees. This particular beamwidth is achieved with the antenna element 12 including the ground reference plate 16. The elevation beamwidth is nearly omni-directional without the use of the plate 16. In FIG. 6D, the azimuth beamwidth produced in accordance with the present invention is shown having an angle of approximately 6.3 degrees. As will be understood, the azimuth angle may be beamsteered if the present invention comprises beamsteering capabilities.

It will be understood that the antenna element 12 of the present invention may be utilized in communications systems having different frequency bandwidths. The length and cross sectional shape (length of sides) of the antenna element 12, the width of the slot 14, the number of feed points 40 and/or the spacing of the feed points along the slot may be modified to produce the desired results consistent with the present invention.

As will be appreciated, the antenna element 12 having one continuous slot 14 with a plurality of feed points 40 spaced along the slot 14 functions substantially different from a conventional slot antenna having an array of discrete slots. However, the pattern, beamwidth and beamsteering capabilities are consistent with a conventionally fed antenna array made of discrete elements, but with the added benefit of reduced sidelobe levels (from a continuous fed aperture), fifty ohm input impedance and increased gain. Additionally, polarization purity in the antenna element 12 of the present invention is greater than that produced by a conventional array of half-wave or full-wave slots.

Although a preferred embodiment of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention.

We claim:

1. An antenna radiating element comprising:

an elongated tube having a single aperture extending substantially along the longitudinal axis of the tube, the elongated tube having a perimeter and an aperture width to establish an input impedance for the radiating element of approximately fifty ohms; and a plurality of feed points substantially equally spaced along and extending across the aperture.

2. An elongated radiating element comprising:

an elongated tube having a single aperture extending substantially the length of the tube along the longitudinal axis thereof;

a plurality of feed points substantially equally spaced along the aperture;

and a feed distribution network comprising a plurality of n-bit phase shifters individually connected in the feed path leading to one of said feed points to apply a signal progressively shifted in phase at each successive feed point along the length of said tube.

3. An elongated radiating element comprising:

an elongated tube having a single aperture extending substantially along the longitudinal axis of the tube;

a plurality of feed points substantially equally spaced along the aperture; and a feed distribution network including a plurality of delay lines individually connected to a respective feed point.

* * * * *